US008573169B2

(12) United States Patent
Matsunaga et al.

(10) Patent No.: US 8,573,169 B2
(45) Date of Patent: Nov. 5, 2013

(54) VARIABLE VALVE DEVICE FOR AN INTERNAL COMBUSTION ENGINE

(75) Inventors: Ayatoshi Matsunaga, Okazaki (JP); Daisuke Yoshika, Okazaki (JP); Katsuhiro Tanaka, Okazaki (JP); Shinichi Murata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 98 days.

(21) Appl. No.: 13/393,078

(22) PCT Filed: Dec. 20, 2010

(86) PCT No.: PCT/JP2010/072886

§ 371 (c)(1),
(2), (4) Date: Feb. 28, 2012

(87) PCT Pub. No.: WO2011/089809

PCT Pub. Date: Jul. 28, 2011

(65) Prior Publication Data

US 2012/0160197 A1 Jun. 28, 2012

(30) Foreign Application Priority Data

Jan. 25, 2010 (JP) ..... 2010-013108

(51) Int. Cl.
*F01L 1/34* (2006.01)
*F01L 1/04* (2006.01)

(52) U.S. Cl.
USPC ..... 123/90.17; 123/90.6

(58) Field of Classification Search
USPC ..... 123/90.15–90.17, 90.27, 90.31, 90.6
See application file for complete search history.

(56) References Cited

U.S. PATENT DOCUMENTS 6,186,102 B1 2/2001 Kosuge et al.
8,186,319 B2 * 5/2012 Pluta et al. ..... 123/90.17

(Continued)

FOREIGN PATENT DOCUMENTS

DE 4419557 C1 10/1995
GB 2 424 257 A 9/2006

(Continued)

OTHER PUBLICATIONS

Extended European Search Report dated Apr. 16, 2013 for European Application No. 10843973.8.

(Continued)

*Primary Examiner* — Zelalem Eshete
*Assistant Examiner* — Steven D Shipe
(74) *Attorney, Agent, or Firm* — Birch, Stewart, Kolasch & Birch, LLP

(57) ABSTRACT

A variable valve device of the invention has a structure in which, as connecting means for connecting a movable cam 22 located in an outer periphery of an outer camshaft 17*a* and an inner camshaft 17*b* located inside the outer camshaft 17*a*, there are provided a pin-like member 24 that is movably inserted so as to penetrate the movable cam 22, the outer camshaft 17*a* and the inner camshaft 17*b* along a diametrical direction of a shaft member 17 that is formed by turnably encasing the inner camshaft 17*b* in the outer camshaft 17*a*, and an escape-preventing portion 50 disposed in the end portion of the pin-like member 24. The movable cam 22 and the inner camshaft 17*b* are thus connected together while preventing large press-fit load and axial force from acting on components.

6 Claims, 14 Drawing Sheets

(56) References Cited

U.S. PATENT DOCUMENTS

| | | | | |
|---|---|---|---|---|
| 8,225,762 | B2 * | 7/2012 | Lancefield et al. | 123/90.17 |
| 2010/0132640 | A1 * | 6/2010 | Methley et al. | 123/90.6 |
| 2010/0282193 | A1 * | 11/2010 | Timothy et al. | 123/90.17 |

FOREIGN PATENT DOCUMENTS

| | | | |
|---|---|---|---|
| JP | 52-32647 | U | 3/1977 |
| JP | 10-325309 | A | 12/1998 |
| JP | 2000-240412 | A | 9/2000 |
| JP | 2009-144521 | A | 7/2009 |
| JP | 2009-144522 | A | 7/2009 |
| KP | 10-1998-071049 | A | 10/1998 |
| KP | 10-2009-0064806 | A | 6/2009 |
| WO | WO 2009/005999 | A1 | 1/2009 |

OTHER PUBLICATIONS

Japanese Office Action issued in Japanese Patent Application No. 2011-550814 on May 9, 2012.

Korean Office Action issued in Korean Patent Application No. 10-2012-7005390 on Dec. 13, 2012.

* cited by examiner

BACK
FRONT
ECU
110
45
72
81
89
84
85
82
86
87
88
18a
39
70a
70
70b
83
83
40
20
18b
22a
22
24a
22b
17
17a
17b
26
9
10
10
10
10
2
120
92
76
74
101
71
71a
71b
91
92
18c
93
90
75
73
100
24c
22b
22a
22
24a
22

VARIABLE VALVE DEVICE FOR AN INTERNAL COMBUSTION ENGINE

TECHNICAL FIELD

The present invention relates to a variable valve device for an internal combustion engine, in which a movable cam is variable in phase on the basis of a reference cam.

BACKGROUND ART

In the case of a reciprocal engine (internal combustion engine) for automobiles, for the purpose of improving measures against engine exhaust gas and reducing pumping loss, a variable valve device is more and more often installed in its cylinder head.

In some of such variable valve devices, an inner camshaft is turnably encased in an outer camshaft formed of a pipe member to function as a shaft member driven by crank output of the engine. In the outer periphery of the outer camshaft, there are provided a fixed reference cam and a movable cam that is turnable around the shaft axis. A pin-like member that is inserted in between the movable cam and the inner camshaft from a shaft-diametrical direction is used to connect the outer camshaft and the inner camshaft while allowing relative displacement. Due to this structure, the inner camshaft is relatively displaced by output of the outer camshaft, and the movable cam is varied in phase relative to the reference cam by output from the pin-like member connected to the inner camshaft, to thereby change the duration for which the valve is open (split variable) (see Patent Documents 1 and 2).

In the variable valve device, it is required to connect the inner camshaft and the movable cam, which are located in the inside and outside, respectively, of the outer camshaft with simple work. To that end, it has been proposed that a press-fit pin be used as the pin-like member for connecting the movable cam and the inner camshaft, and that the press-fit pin be pressed in along the shaft-diametrical direction to connect the movable cam and the inner camshaft located in the inside and outside, respectively, of the outer camshaft. It has also been proposed that a bolt member be used as the pin-like member, and that this bolt member be screwed into the inner camshaft to connect the movable cam and the inner camshaft located in the inside and outside, respectively, of the outer camshaft.

PRIOR ART

Patent Documents

Patent Document 1: Unexamined Japanese Patent Publication (Kokai) No. 2009-144521

Patent Document 2: Unexamined Japanese Patent Publication (Kokai) No. 2009-144522

SUMMARY OF THE INVENTION

Problems to be Solved by the Invention

In the case of the former structure in which the press-fit pin is pressed into the movable cam and the inner camshaft, a large load has to be applied to press the press-fit pin into the movable cam and the inner camshaft lest the press-fit pin come off due to amplitude load of valve driving. The press-fit load deforms or bends the movable cam or the inner camshaft or causes a positional displacement of the inner shaft in the direction of the press-fit pin. Moreover, the outer camshaft formed of the pipe member has low rigidity. For that reason, if deformation, bending or positional displacement occurs in the movable cam or the inner camshaft, this increases friction between the outer camshaft and the movable cam or inner camshaft or produces additional friction due to contact therebetween.

On top of that, as the result of the deformation or bending, even an outer pipe is deformed or bent, too. If the deformation or bending of the outer pipe affects the straightness of the cam shaft axis and the cylindricality of an outer diameter, this might lead to an increase in friction of a journal bearing between the camshaft and the cylinder head or friction between the cam and a tappet attributable to an increase in misalignment.

In the case of the latter structure in which the screw member is screwed in, a fastening force is applied to a threaded portion of the inner camshaft, so that the inner camshaft is deformed or bent, causing friction as in the above-mentioned case. Furthermore, the structure is a cantilever structure, and therefore induces stress concentration. It is then necessary to improve the strength of adjacent areas of the threaded portion, which causes another problem that compact design cannot be achieved.

Such friction not only deteriorates the response of the variable valve device but also increases friction in the entire engine, thus degrading fuel consumption and causing abnormal wear of components.

It is an object of the invention to provide a variable valve device for an internal combustion engine, in which the movable cam on the outer periphery of the outer camshaft and the inner camshaft in the outer camshaft can be connected together, and at the same time, friction is prevented from being generated between components.

Means for Solving the Problem

In order to achieve the above object, the first aspect of the invention has a structure in which, as connecting means for connecting a movable cam located in an outer periphery of an outer camshaft and an inner camshaft located inside the outer camshaft, there are provided a pin-like member that is movably inserted so as to penetrate the movable cam, the outer camshaft and the inner camshaft along a diametrical direction of a shaft member that is formed by turnably encasing the inner camshaft in the outer camshaft, and an escape-preventing portion for restricting the pin-like member from escaping. The movable cam and the inner camshaft are connected together by using the above structure while preventing press-fit load and axial force from acting on components.

According to the second aspect of the invention, the escape-preventing portion for restricting the escape of the pin-like member is disposed in an end portion of the pin-like member.

The third aspect of the invention has a structure in which the pin-like member is designed to have length longer than a penetration zone to prevent stress from being concentrated at the escape-preventing portion. The pin-like member is arranged in the shaft member to be displaceable in the diametrical direction of the shaft member while retaining the escape-preventing portion. A releasing portion is formed in the escape-preventing portion and an end of the penetration zone, to and from which the escape-preventing portion is attached and separated, the releasing portion releasing the escape-preventing portion from the end of the penetration zone when load is applied to a portion between the escape-preventing portion and the end of the penetration zone. The farther the escape-preventing portion moves away from the end of the penetration zone, the more the pin-like member is displaced in an axial direction.

According to the fourth aspect of the invention, in order to achieve the escape prevention of the pin-like member with a simple structure, a swaging process is applied to the end portion of the pin-like member, and a large-diameter portion that is formed in the end portion of the pin-like member by the swaging process is used as the escape-preventing portion.

The fifth aspect of the invention has a structure in which the escape-preventing portion is arranged in the movable cam and restricts the pin-like member from escaping outside the movable cam along the axial direction.

According to the sixth aspect of the invention, in order that the escape prevention of the pin-like member may be easily achieved, the movable cam is provided with a cylindrical boss portion that is turnably fitted to the outer periphery of the outer camshaft. The pin-like member penetrates through a circumferential wall of the boss portion of the movable cam. The escape-preventing portion has a structure in which a stopper that is fitted to an outer periphery of the boss portion is used to prevent the escape of the pin-like member.

According to the seventh aspect of the invention, the stopper is formed into a ring so that the escape-preventing portion may be easily mounted on the boss portion with a simple structure.

According to the eighth aspect of the invention, the end portion of the pin-like member is formed into a spherical face to prevent stress from being applied from the pin-like member to the stopper in a concentrated manner.

Advantages of the Invention

According to the first aspect of the invention, it is possible to connect the movable cam located on the outer periphery of the outer camshaft and the inner camshaft located inside the outer camshaft without applying the press-fit load and axial force, which trigger a deformation and bending in components.

In result, the movable cam and the inner camshaft can be connected together while avoiding not only friction generation between components, attributable to the deformation and the bending, but also deformation in other components. Consequently, it is possible to secure stable variable performance and also to avoid an increase in engine friction, to thereby prevent abnormal wear of components. If the position at which the stress is applied to the pin-like member is changed, the pin-like member can be formed in a compact size.

According to the second aspect of the invention, the pin-like member is prevented from escaping with a simple structure by the escape-preventing portion that is formed in the end portion of the pin-like member.

According to the third aspect of the invention, it is possible, with a simpler structure, to avoid the stress concentration on the escape-preventing portion and prevent the escaping of the pin-like member, attributable to the stress concentration.

According to the fourth aspect of the invention, it is possible to retain the pin-like member with a simple structure in which the pin-like member is subjected to the swaging process.

According to the fifth aspect of the invention, the pin-like member is prevented from escaping with a simple structure by the escape-preventing portion that is formed in the movable cam.

According to the sixth aspect of the invention, it is possible to retain the pin-like member through an easy work that fits the stopper in the boss portion of the movable cam.

According to the seventh aspect of the invention, the ring-like stopper makes it possible to restrict the pin-like member from escaping in both axial directions with a simple structure and the easy work in which the stopper is fitted in the boss portion.

According to the eighth aspect of the invention, it is possible to avoid the stress concentration of the stopper, attributable to displacement of the pin-like member, to thereby assure highly reliable connection.

BEST MODE OF CARRYING OUT THE INVENTION

The invention will be described below with reference to a first embodiment shown in FIGS. 1 to 5.

Figure 1:
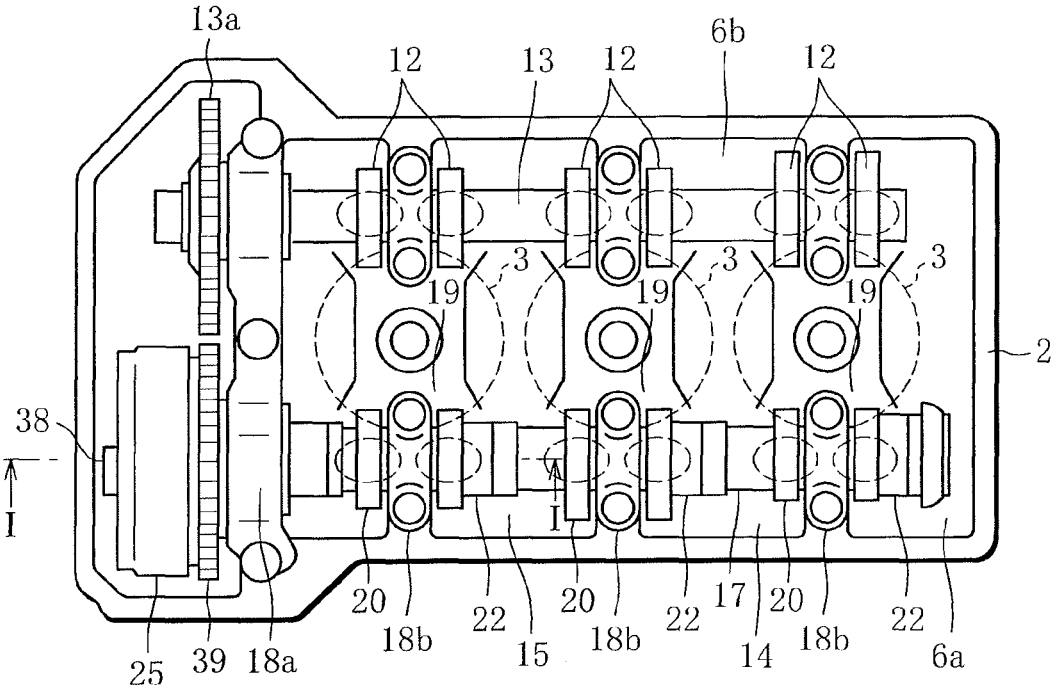
FIG. 1 is a plan view showing a variable valve device according to a first embodiment of the invention together with a cylinder head for an internal combustion engine equipped with the device.
Figure 2:
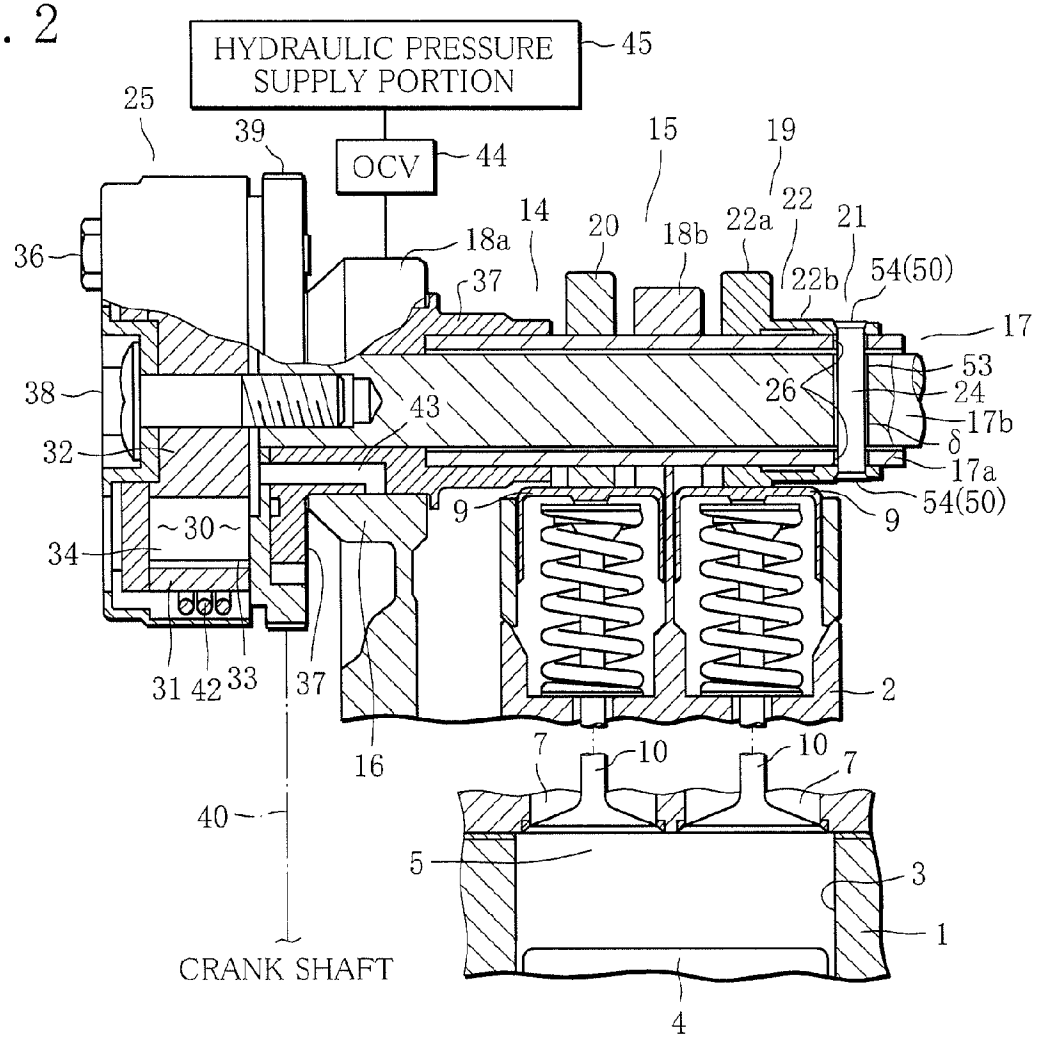
FIG. 2 is a sectional view of the variable valve device, taken along line I-I of FIG. 1.

FIG. 1 shows a plan view of an internal combustion engine, for example, a three-cylinder (multicylinder) reciprocal engine (hereinafter, referred to simply as an engine). FIG. 2 shows a cross-section taken along line I-I of FIG. 1. In FIG. 2, "1" denotes a cylinder block of the engine, and "2" denotes a cylinder head mounted on a head portion of the cylinder block 1.

In the cylinder block 1, three cylinders 3 (only partially shown) are formed along an anteroposterior direction of the engine as shown in FIGS. 1 and 2. Pistons 4 (shown only in FIG. 2) are reciprocatably encased in the respective cylinders 3, which branch from a crankshaft (not shown) through a con rod (not shown).

A combustion chamber 5 is formed under the cylinder head 2 correspondingly to each of the cylinders 3. A pair of intake ports 7 that intakes air and a pair of exhaust ports (not shown) that discharge air open in each of the combustion chambers 5. Each of the intake ports 7 is provided with a pair of intake valves 10 attached with tappets 9. The tappet 9 located on the top faces an upper portion of the cylinder head 2. Likewise, each of the exhaust ports (not shown) is provided with a pair of exhaust valves (not shown). The intake valves 10 and the exhaust valves (not shown) are used to open and close the intake ports 7 and the exhaust ports (not shown). An ignition plug, not shown, is disposed in each of the combustion chambers 5.

As shown in FIG. 1, an intake-side valve device 6*a* and an exhaust-side valve device 6*b*, which are driven by shaft output of the crankshaft, are arranged on the right and left of the upper portion of the cylinder head 2. A predetermined combustion cycle (four cycles including an intake stroke, a combustion stroke, an expansion stroke and an exhaust stroke) is repeatedly performed in each of the cylinders 3. Between these valve devices 6*a* and 6*b*, the exhaust-side valve device 6*b* has a structure using a normal camshaft 13. To be more precise, the camshaft 13 is a camshaft integrally including a pair of exhaust cams 12, and more specifically, the camshaft 13, as shown in FIG. 1, in which the exhaust cams 12 for three cylinders are formed by machining. The camshaft 13 is rotatably installed in a direction that the cylinders 3 are aligned and bring a cam face of each of the exhaust cams 12 into contact with a base end portion of an exhaust valve (not shown). By so doing, a driving force of the cam of the exhaust cam 13 is transmitted to the exhaust valve (not shown).

Figure 3:
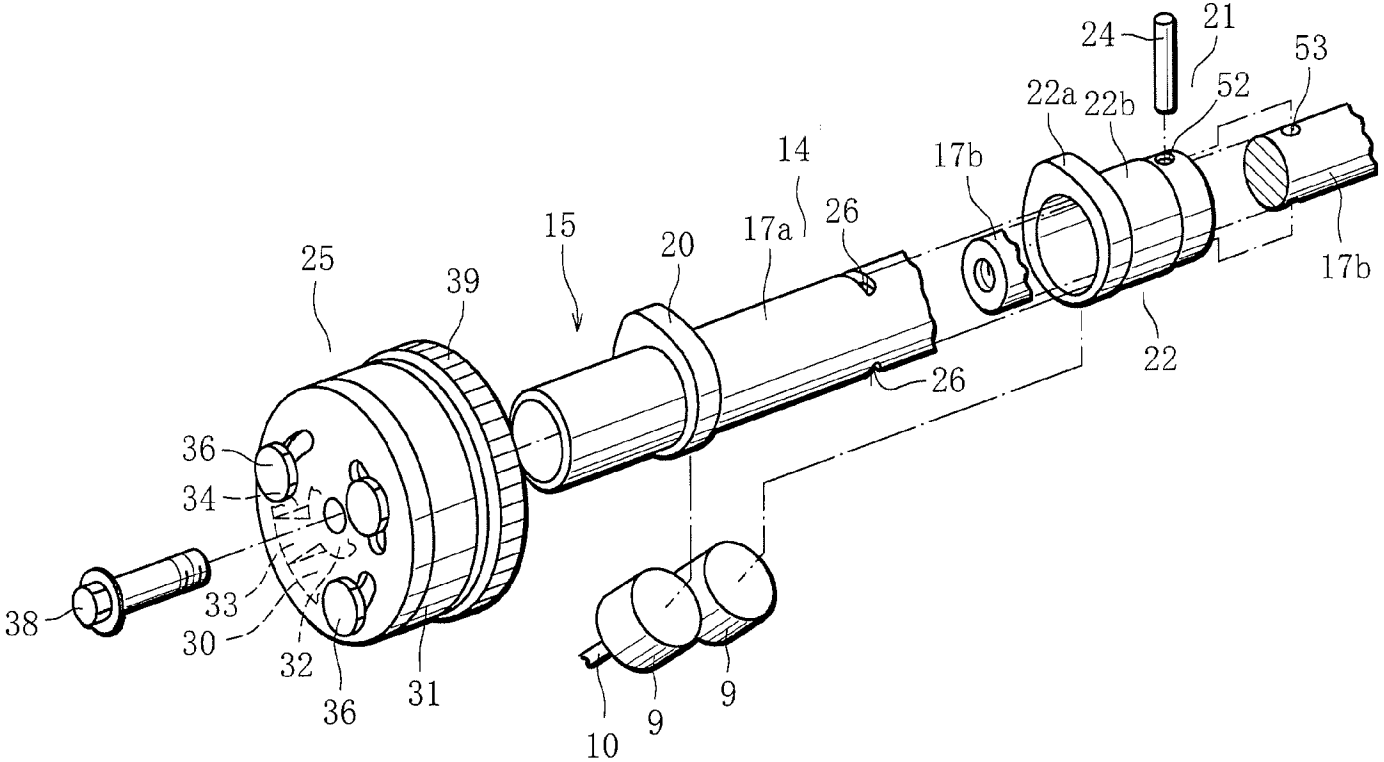
FIG. 3 is a perspective view showing a structure of the variable valve device.
Figure 4:
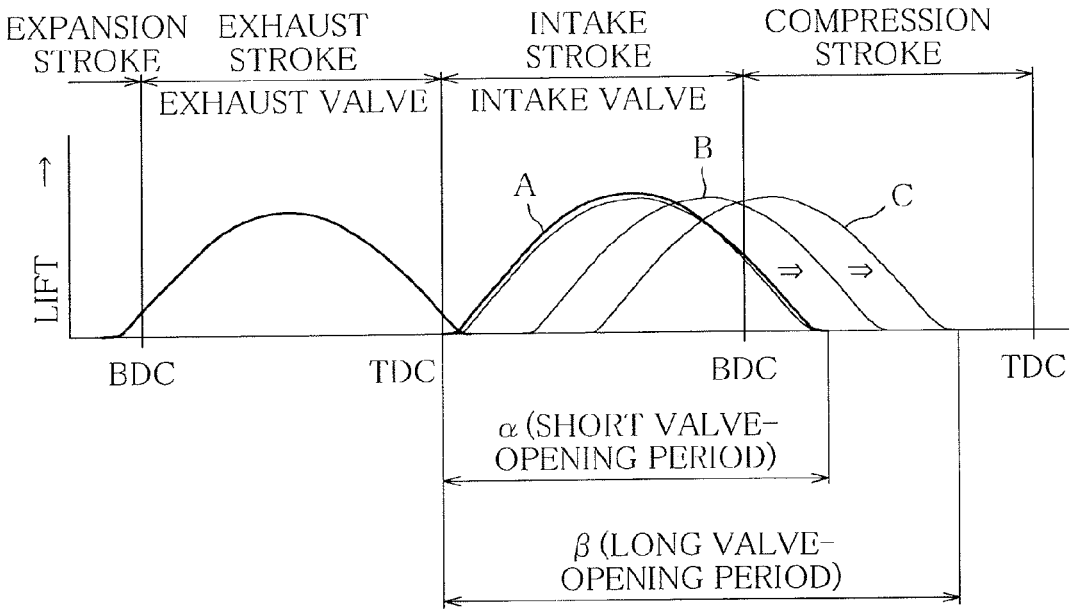
FIG. 4 is a line map showing variable characteristics of the variable valve device.

Unlike the exhaust camshaft 13, the intake-side valve device 6*a* uses a camshaft formed by installing a separate member as shown in FIGS. 2 and 3, or a camshaft 14 in a so-called assembled cam structure. The camshaft 14 is used to form a split variable valve device 15 as shown in FIGS. 2 and 3.

The variable valve device 15 will be described below. A shaft member of the camshaft 14 is formed of double shaft 17 in which an inner camshaft 17*b* formed of a shaft member serving as a control member is turnably encased in an outer camshaft 17*a* formed of a hollow pipe member, for example, as shown in FIGS. 2 and 3. The double shaft 17 is disposed along the direction that the cylinders 3 are aligned as with the exhaust camshaft 13. One end portion (one side) of one of the double shaft 17, namely, one end portion of the outer camshaft 17*a* is turnably supported by a bearing 18*a* that is situated in one end portion (one side) of the cylinder head through a cam piece 37 attached to an end of the outer camshaft 17*a*. A middle portion of the outer camshaft 17*a* is rotatably supported to a middle bearing 18*b* located between the tappets 9. This way, both the shafts 17*a* and 17*b* can rotate around the same axis. There is provided a clearance between the outer camshaft 17*a* and the inner camshaft 17*b* so that friction is prevented at the time of relative displacement.

A pair of intake cams 19 is provided to the outer camshaft 17*a* so as to corresponding to a pair of intake valves 10 with respect to each cylinder. The intake cams 19 are each formed by assembling a reference cam 20 deciding a reference phase and a cam lobe 22 (corresponding to the movable cam of the present application) serving as a movable cam.

The reference cam 20 is fastened in an outer periphery so as to coincide with one tappet of the outer camshaft 17*a*, for example, the left-side tappet 9. The reference cam 20 is made of a plate cam. The reference cam 20 is, for example, fastened to the outside of the outer camshaft 17*a* by press-fitting and is fastened above the left-side tappet 9. In this structure, a cam face of the reference cam 20 contacts the left-side tappet 9, and thus, the cam displacement of the reference cam 20 is transmitted to the left-side intake valve 10.

The cam lobe 22 has a cam nose 22*a* made of a plate cam. The cam nose 22*a* is combined with a portion for preventing misalignment, that is, a hollow boss portion 22*b*, thereby forming the entire cam lobe. The cam lobe 22 is fitted to the outside of the outer camshaft 17*a* to be turnable in a circumferential direction, and the cam nose 22*a* is located above the right-side tappet 9. In this structure, the cam face of the cam nose 22*a* comes into contact with the right-side tappet 9, and thus, the cam displacement of the cam nose 22*a* is transmitted to the right-side intake valve 10.

The boss portion 22*b* of the cam lobe 22 and the inner camshaft 17*b* are connected to each other with connecting means, for example, a connecting structure 21 that makes a pin member 24 (corresponding to the pin-like member of the present application) insert into the double shaft 17 along shaft-diametrical direction.

As shown in FIG. 3, in a circumferential wall of the outer camshaft 17*a* through which the pin member 24 penetrates, there is formed a through-hole for relative displacement release, which allows relative displacement between the outer camshaft 17*a* and the inner camshaft 17*b*, for example, a pair of long holes 26 extending in a retard direction that releases the pin member 24. This enables the relative displacement between the outer camshaft 17*a* and the inner camshaft 17*b*. When the inner camshaft 17*b* is displaced relative to the outer camshaft 17*a*, a cam phase of the cam nose 22*a* can be varied from a cam phase of the reference cam 20, which serves as a reference, to a cam phase that is retarded in a great degree. The connecting structure 21 that achieves the variability of the cam phase will be explained below in details.

A cam-phase changing mechanism 25 that makes relative displacement between the inner and outer shafts is mounted on one end portion of the double shaft 17, thereby forming the variable valve device 15 that is capable of changing the cam phase of the cam lobe 22 on the basis of the reference cam 20.

In other words, the cam-phase changing mechanism 25 uses a turning vane structure in which, for example, as shown in FIGS. 2 and 3, a vane portion 34 having a plurality of vanes 33 extending from an outer peripheral portion of a shaft portion 32 in a radial pattern is turnably encased in a cylindrical housing 31 having a plurality of retard chambers 30 arranged in a circumferential direction, and the vanes 33 divide the inside of the retard chambers 30. The housing 31 is coupled to the cam piece 37 attached to the end of the outer camshaft 17*a* with fastening bolts 36. The shaft portion 32 of the vane portion 34 is coupled to a shaft end of the inner camshaft 17*b* with a fastening bolt 38. When the vanes 33 are turned and displaced within the retard chambers 30, the inner camshaft 17*b* is displaced relative to the outer camshaft 17*a*.

The cam phase of the cam lobe 22 coincides with that of the reference cam 20 serving as a reference due to a biasing force of a return spring member 42 (shown only in FIG. 2) that is placed to connect the housing 31 and the vane portion 34. The retard chambers 30 are connected to an oil control valve 44 (hereinafter, referred to as an OCV 44) and a hydraulic pressure supply portion 45 (formed, for example, of a device having an oil pump for supplying oil) through various oil passages 43 (shown only in FIG. 2) which are formed in the housing 31, the cam piece 37 and the bearing 18*a*. In short, when oil is supplied into the retard chambers 30, split variable is carried out, which displaces the cam lobe 22 from the reference cam 20 in a retard direction as shown in a line map of FIG. 4.

The shaft output from the crankshaft (not shown) is transmitted, for example, from a timing sprocket 39 provided to the housing 31 and a timing chain 40 hitched to a timing sprocket 13*a* provided to the end of the exhaust camshaft 13 through the housing 31 and the cam piece 37 to the outer camshaft 17*a*, thereby rotating-driving the reference cam 20 and thus opening/closing the left-side intake valve 10 through the tappet 9. Once hydraulic pressure is supplied from the OCV 44 into advance chambers located opposite the retard chambers 30, the cam lobe 22 rotates with the reference cam 20 while coinciding with the cam phase of the reference cam 20 as shown in a state A of FIG. 4 in consort of the biasing force of the return spring member 42. For this reason, the right-side intake valve 10 is opened/closed while maintaining the same phase as the left-side reference cam 20. After the hydraulic pressure of the hydraulic pressure supply portion 45 is supplied into the retard chambers 30 through the OCV 44, the vanes 33 is displaced from an initial position towards the retard side within the retard chambers 30 in proportion to the supplied hydraulic pressure. In this process, for example, if the vanes 33 are displaced partway within the retard chambers 30 by controlling the supplied hydraulic pressure, the inner camshaft 17*b* is displaced in the retard direction to a halfway position. The displacement of the inner camshaft 17*b* at this point of time is transmitted to the pin member 24. The output of the pin member 24 which is outputted from the inner camshaft 17*b* makes the cam nose 22*a* of the cam lobe 22 move in the retard direction. Because of this cam phase, as shown in a state B of FIG. 4, the opening/closing timing of the left-side intake valve 10 serving as a reference is unchanged, and only the opening/closing timing of the right-side intake valve 10 is changed. In other words, the right-side intake valve 10 starts being opened/closed according to a cam profile of the cam nose 22*a* in the middle of an open/closed period of the left-side intake valve 10. If the vanes 33 are displaced to a most retarded position by controlling the supplied hydraulic pressure, as shown in a state C of FIG. 4, the opening/closing timing of the left-side intake valve 10 is unchanged, and the right-side intake valve 10 is opened/closed with most retarded timing relative to the left-side intake valve 10 while maintaining a state synchronizing with the opening/closing timing of the left-side intake valve 10. The right and left intake valves 10 are varied according to an engine condition within a range between a shortest valve-opening period $\alpha$ and a longest valve-opening period $\beta$ (split variable).

Figure 5:
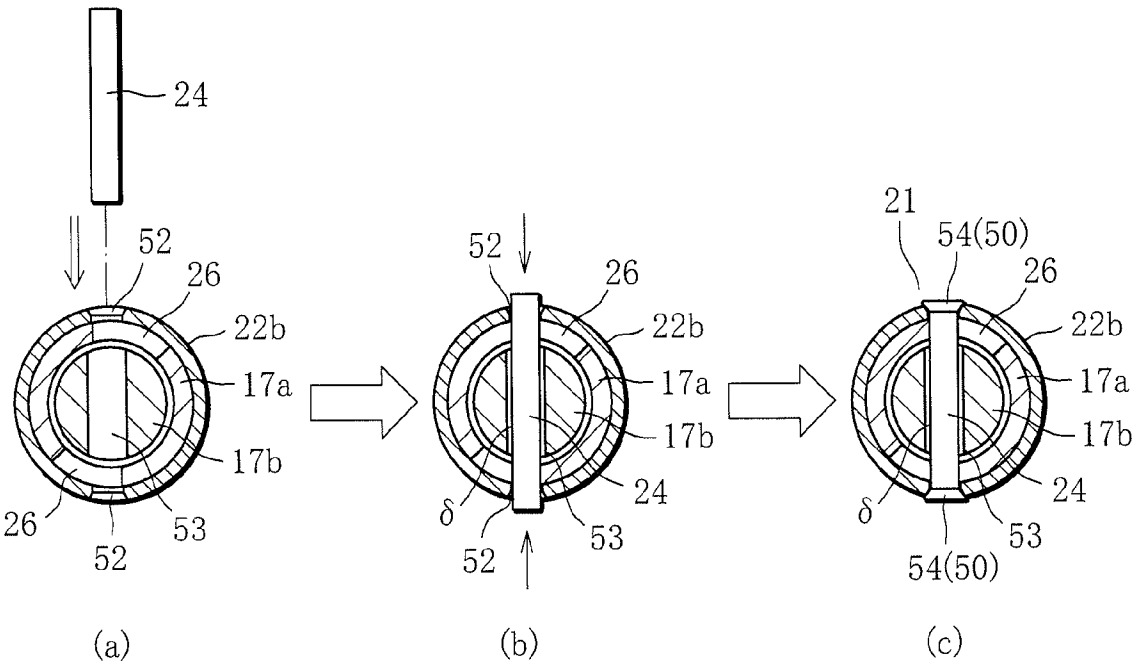
FIG. 5 is a sectional view showing a procedure starting with the fixing of a pin-like member and ending with the formation of an escape-preventing portion.

The connecting structure 21 that inserts the pin member 24, which enables the above-mentioned split variable, has a structure that connects the cam lobe 22 and the inner camshaft 17*b* while preventing friction between components. In such a structure, as shown in FIGS. 2 and 5, for example, the pin member 24 that can be subjected to a swaging process is movably inserted through the boss portion 22*b*, the long hole 26 of the outer camshaft 17*a* and the inner camshaft 17*b* along the shaft-diametrical direction. An escape-preventing portion 50 is formed in each end portion of the pin member 24. The cam lobe 22 and the inner camshaft 17*b* are connected to each other without contact between the pin member 24 and inner surfaces of the holes in which the pin member 24 is inserted.

As shown in FIGS. 2 and 5(*a*), each through hole 52 in which the pin member 24 of the boss portion 22*b* (cam lobe 22) is inserted and a through hole 53 in which the pin member 24 of the inner camshaft 17*b* is inserted are each formed into a hole with an internal diameter that is slightly larger than the diameter of the pin member 24. As shown in FIGS. 5(*b*) and 5(*c*), the pin member 24 is inserted through penetration zones, such as the boss portion 22*b*, the outer camshaft 17*a* and the inner camshaft 17*b*, without contacting the components due to a clearance $\delta$ created between the pin member 24 and inner surfaces of the through holes 52 and 53 (movable insertion). The escape-preventing portion 50 has a structure in which the end portions of the pin member 24 are subjected to the swaging process after the penetration of the pin member 24, for example, as shown in FIGS. 5(*b*) and 5(*c*), to thereby form large diameter portions 54 larger than the internal diameter of the through hole 52. In this structure, the pin member 24 movably inserted is restricted from escaping by the large diameter portions 54 formed at both the end portions of the pin member 24. Since the pin member 24 is prevented from escaping by the large diameter portions 54, the pin member 24 may be moved in an axial or turning direction thereof. Unlike a press-fit structure and a screwing structure, the structure in which the movable insertion of the pin member 24 and the escape prevention are combined together enables the connection between the cam lobe 22 located in the periphery of the outer camshaft 17*a* and the inner camshaft 17*b* located in the inside of the outer camshaft 17*a* without applying a large press-fit load and a large axial force, which trigger a deformation and bending, to the outer camshaft 17*a* and the inner camshaft 17*b*, as shown in FIGS. 2 and 5(*c*).

The cam lobe 22 and the inner camshaft 17*b* can therefore be connected to each other while unnecessary friction between components is prevented. This makes it possible to secure stable variability and prevent abnormal wear of components by avoiding an increase in engine friction. In particular, if the large diameter portions 54 formed by the swaging process are provided to the escape-preventing portions 50, the pin member 24 can be prevented from escaping with a simple structure.

The movable insertion of the pin member 24 differs from the conventional press-fit structure and screwing structure in which a reaction force driving valves constantly acts upon the same place of the pin member. In the movable insertion, load acts upon different places, so that if a pin diameter is made small, it is possible to achieve weight saving and a compact design. The compact design enables the decrease of weight, and makes it easier to improve variability response and apply the pin member to the engine. If lubricating oil is supplied to the clearance between the outer camshaft 17*a* and the inner camshaft 17*b*, the lubricating oil is also supplied to a gap between the camshafts 17 and the pin member 24. For that reason, an impact load that acts upon the pin member 24 is suppressed by an oil film, and the shifting of the pin member 24 becomes easy, making it possible to further improve the compact design of the pin member 24.

If lubricating oil is supplied to the clearance between the outer camshaft 17*a* and the inner camshaft 17*b*, the oil film makes the outer camshaft 17*a* and the inner camshaft 17*b* less likely to contact each other. Even if they are in contact, the increase of friction is prevented.

Figure 6:
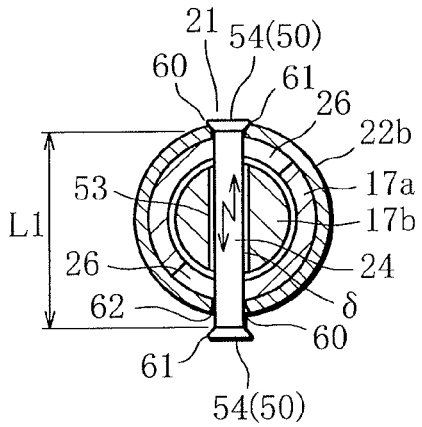
FIG. 6 is a sectional view showing a connection structure using the pin-like member that is a substantial part of a second embodiment of the invention.
Figure 7:
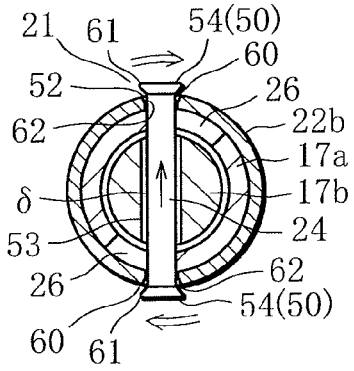
FIG. 7 is a sectional view for explaining a behavior that prevents the concentration of stress applied from the pin-like member onto the escape-preventing portion.

FIGS. 6 and 7 show a second embodiment of the invention.

The second embodiment is a modification of the first. According to the second embodiment, when split variable is carried out, stress is prevented from being concentrated at the large diameter portions 54 (escape-preventing portion 50). When the displacement outputted from the inner camshaft 17*b* is transmitted to the pin member 24, the transmission is carried out by bringing the large diameter portions 54 of the pin member 24 and the through hole 52 (boss portion 22*b*) of the cam lobe 22 into contact. During the transmission, an outer periphery (shaft portion) of the pin member 24, except the large diameter portions 54, is away from the inner surface of the through hole of the cam lobe 22 because of the clearance 6, so that load is concentrated at the large diameter portions 54. This stress is concentrated at portions of the large diameter portions 54, which are noticeably different in diameter from the rest and is considered to be low in rigidity, namely, base portions of the large diameter portions 54. This raises the possibility that the large diameter portion 54 may be broken at the base portion thereof due to the stress concentration and may come off from the pin member 24. If the large diameter portion 54 comes off from the pin member 24, the large diameter portion 54 might bite into the engine, and the pin member 24 might fall off from the double shaft 17, leading to a damage on the engine.

According to the second embodiment, to solve the above problem, when load is applied between the large diameter portion 54 and the through hole 52, the large diameter portions 54 escape, and the load is received by the shaft portion of the pin member 24, which has stable strength, instead of bringing the outer periphery (shaft portion) of the pin member 24 and the inner surface of the through hole 52 into contact with each other.

More specifically, as shown in FIG. 6, length L1 of the pin member 24 (distance between the base portions of the large diameter portions 54) is set longer than the penetration zone in which the pin member 24 penetrates through the cam lobe 22, the outer camshaft 17*a* and the inner camshaft 17*b*, thereby making the entire pin member 24 displaceable in the diameter direction of the double shaft 17 while keeping the large diameter portions 54 as they are. Furthermore, the large diameter portions 54 and the end portions of the penetration zone, which come to contact with and move away from the large diameter portions 54, namely, open end portions of the through hole 52 of the boss portion 22*b*, are provided with releasing portions 60. When load is applied to a portion therebetween, the releasing portions 60 release the large diameter portions 54 from the open end portions of the through hole 52. The releasing portion 60 has a structure, for example, in which a triangular portion 61 having oblique sides in a lower part is formed in the outer circumferential portion of the large diameter portion 54, and tapered faces 62 to be combined with the oblique sides of the triangular portion 61 are formed in the open end portion of the through hole 52. When load is applied to a portion between the oblique portion of the triangular portion 61 and the tapered face 62, the large diameter portion 54 is shifted (displaced) away from the through hole 52 due to the effect of obliquity.

With the above structure, when split variable is carried out, and load is applied to a portion between the large diameter portion 54 of the pin member 24 and the through hole 52 of the cam lobe 22, the oblique sides of the triangular portion 61 are displaced on the tapered faces 62 of the through hole 52 by the amount of the clearance δ as shown in FIG. 7. This displacement raises the large diameter portion 54. This is how the large diameter portion 54 is released from the open end portion of the through hole 52. At this point of time, the pin member 24 is allowed to freely shift in the axial direction. As the result of the rise of the large diameter portion 54, therefore, the entire pin member 24 is displaced in the axial direction as shown by an arrow in FIG. 7. The large diameter portion 54 of the pin member 24 moves away from the through hole 52 of the cam lobe 22, whereas the shaft portion of the pin member 24 is disposed in the inner surface of the through hole 52. In other words, the state in which the large diameter portion 54 that is prone to be affected by stress concentration and the through hole 52 are in contact with each other is changed to the one in which the shaft portion of the pin member 24 that is hardly affected by stress concentration, namely, the shaft portion having stable rigidity, and the through hole 52 are in contact with each other, and the output from the inner camshaft 17*b* (relative displacement) is transmitted to the cam lobe 22.

Stress is then prevented from being concentrated on the base portion of the large diameter portion 54 (escape-preventing portion 50). It is therefore possible to avoid the escape of the pin member 24 attributable to stress concentration.

In addition, the lubricating oil seeps through the long hole 26 of the outer camshaft 17*a* and enters the clearance δ between the pin member 24 and the through hole 52. The lubricating oil can supply lubrication for the axial displacement of the pin member 24 and can prevent wear between the pin member 24 and the through hole. Furthermore, it can be considered that wear occurs due to the turning motion of the pin member 24. However, such wear can be prevented by the lubrication.

A third embodiment of the invention will be described below with reference to FIGS. 8 and 9.

Figure 8:
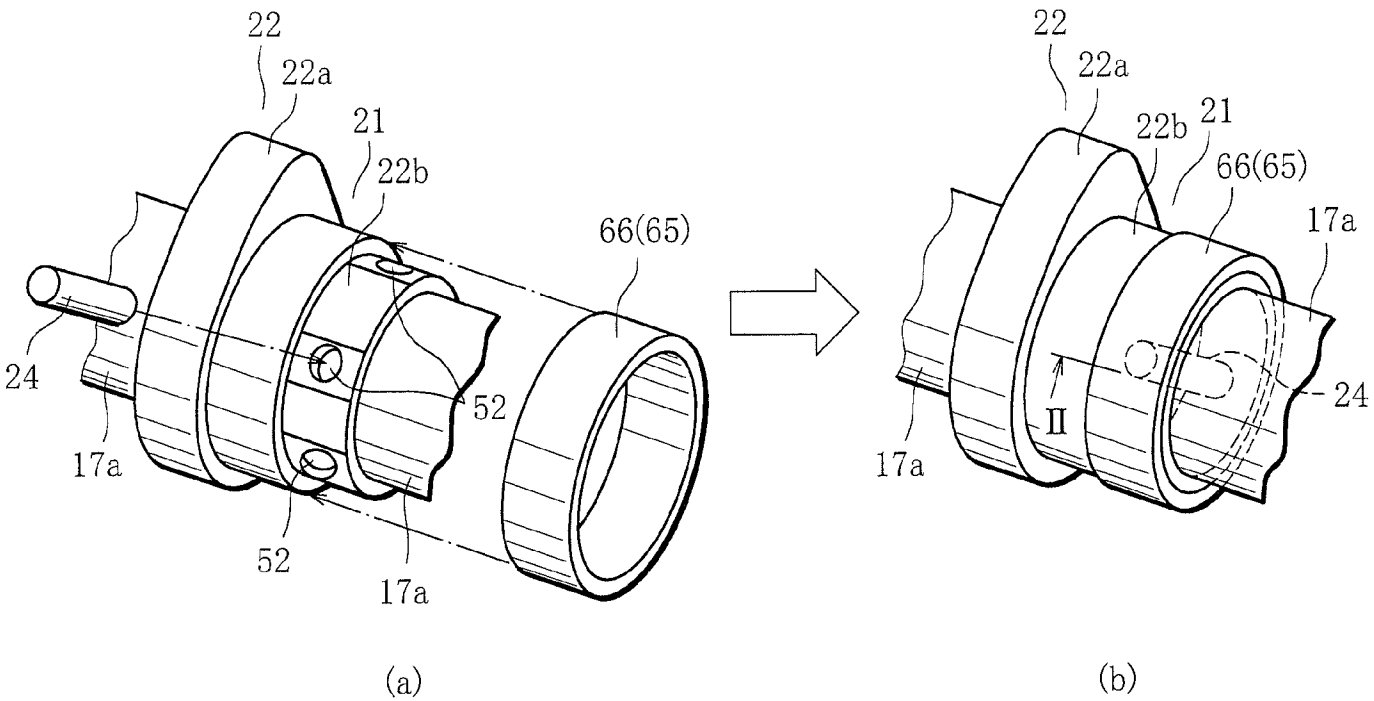
FIG. 8 is a perspective view showing a procedure for connecting a movable cam and an inner camshaft with a pin-like member according to a third embodiment of the invention.
Figure 9:
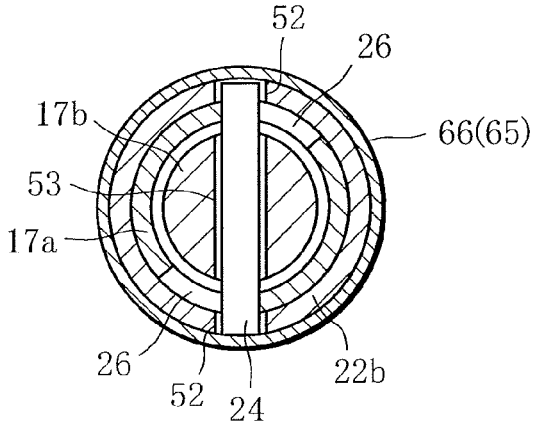
FIG. 9 is a sectional view of a connection structure, taken along line II-II of FIG. 8.

As shown in FIGS. 8 and 9, in this embodiment, a swaging process is not applied to both the end portions of the pin member 24 connecting the cam lobe 22 and the inner camshaft 17*b*, so that the large diameter portion 54 is not provided. The entire length of the pin member 24 is set slightly shorter than an external diameter of the boss portion 22*b*. The pin member 24 is movably inserted and penetrated through the boss portion 22*b*, the long hole 26 of the outer camshaft 17*a*, and the inner camshaft 17*b* along the shaft-diametrical direction. A stopper 65 (independent of the pin member 24) serving as the escape-preventing member of the invention is fitted to an outer periphery of the boss portion 22*b*. The stopper 65 inhibits the pin member 24 from escaping outside the cam lobe 22 along the axial direction of the pin member 24.

As the stopper 65, for example, a ring-like band member 66 is utilized, which can be press-fitted to the outer periphery of the boss portion 22 as shown in FIG. 8(*a*). The band member 66 has such a width that the band member 66 closes an opening of the through hole 52. If the band member 66 is press-fitted from the end of the boss portion 22*b* as far as a point where the through hole 52 is blocked, the end portions of the pin member 24 are blocked with the band as shown in FIGS. 8(*b*) and 9. The pin member 24 is thus restricted from escaping outside the boss portion 22*b*, which retains the connection of the cam lobe 22 and the inner camshaft 17*b*.

The band member 66 may be provided only to cylinders located at ends, in which the pin member 24 is easy to escape because torque fluctuation of all the cylinders is inputted thereto, instead of being provided to all the cylinders.

On the basis of the opening/closing timing of the multicylinder engine, the through hole 52 of the boss portion 22*b* and the through hole 53 of the inner camshaft 17*b* are formed at each predetermined phase angle, that is, for example, at each 120 degrees if the engine is a three-cylinder engine (shown in FIG. 8). This way, even a plurality of cam lobes 22 can be fitted to the inner camshaft 17*b* with the same structure (pin member 24 and band member 66).

With the above structure in which the pin member 24 that is movably inserted in the cam lobe 22 and the camshafts 17*a* and 17*b* is restricted from escaping outside the cam lobe 22 by the stopper 65 fitted to the cam lobe 22 (movable cam), the third embodiment, as with the first, is capable of connecting the cam lobe 22 located in the outer periphery of the outer camshaft 17*a* and the inner camshaft 17*b* located inside the outer camshaft 17*a* to each other without applying the large press-fit load and the large axial force to the cam lobe 22, the outer camshaft 17*a* and the inner camshaft 17*b*, which trigger a deformation and bending.

The prevention of escape of the pin member 24 is easy since it is carried out by using the stopper 65 fitted to the outer periphery of the boss portion 22*b* of the cam lobe 22. In particular, if the ring-like stopper 65 is used, the pin member 24 is restricted from escaping in the axial direction simply by fitting the stopper 65 to the outer periphery of the boss portion 22*b* in which the pin member 24 is movably inserted (because the end portions of the pin member 24 are blocked by the stopper 65). This facilitates the work of connecting the cam lobe 22 and the inner camshaft 17*b*. Particularly, if a plurality of through holes 52 and 53 are formed, the cam lobe 22 can be connected to the inner camshaft 17*b* by using the same components in identical shape in all the cylinders.

Figure 10:
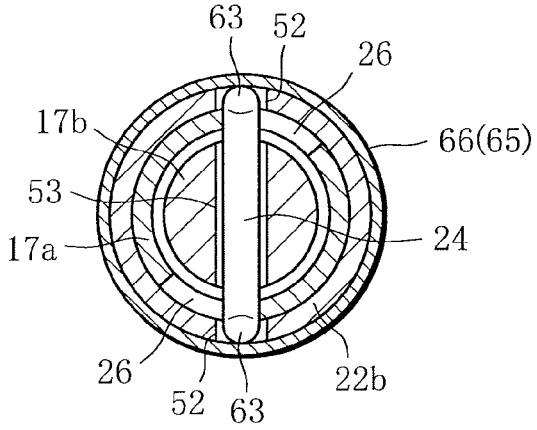
FIG. 10 is a sectional view showing a substantial part of a fourth embodiment of the invention.

FIG. 10 shows a fourth embodiment of the invention.

The fourth embodiment is a modification of the third and is designed to prevent stress concentration on the band member 66 (stopper 65). If the common pin member 24 having flat end faces is used, a corner of the end of the pin member 24 repeatedly comes into contact with the inner surface of the band member 66 when the pin member 24 is displaced in the axial direction along with rotation of the double shaft 17. In result, stress is concentrated only on a part of the band member 66. The stress concentration induces a deformation and fracture in the band member 66. The deformation causes the escape of the band member 66, and the escape and fracture of the band member 66 lead to the escape of the pin member 24. Furthermore, there is the possibility that the pin member 24 that has escaped bites into the engine, leasing to a damage on the engine. For these reasons, stress concentration has to be avoided in order to secure the reliability of components.

To solve these problems, the present embodiment forms the end portions of the pin member 24 into spherical faces and thus eliminates the corner of the pin member 24, which triggers the stress concentration, by forming spherical faces 68. In this manner, the present embodiment prevents the stress from being concentrated on the inner surface of the band member 66. This eliminates the possibility that the band member 66 fractures due to stress concentration and prevents the escape of the pin member 24 attributable to the fracture, making it possible to retain high reliability.

Figure 11:
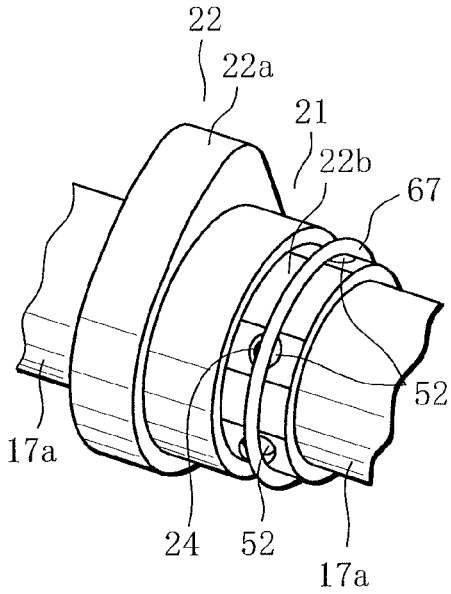
FIG. 11 is a perspective view showing a substantial part of a fifth embodiment of the invention.

FIG. 11 shows a fifth embodiment of the invention.

The fifth embodiment is a modification of the third and the fourth. Instead of using the band member as a stopper, the fifth embodiment utilizes, for example, a snap member 67 formed by shaping a wire member into the shape of letter C. The snap member 67 is fitted to the outer periphery of the boss portion 22*b* so that the pin member 24 is restricted from escaping. Such a structure still provides the same advantages as in the third embodiment.

A sixth embodiment of the invention will be described below with reference to FIGS. 12 and 13.

Figure 12:
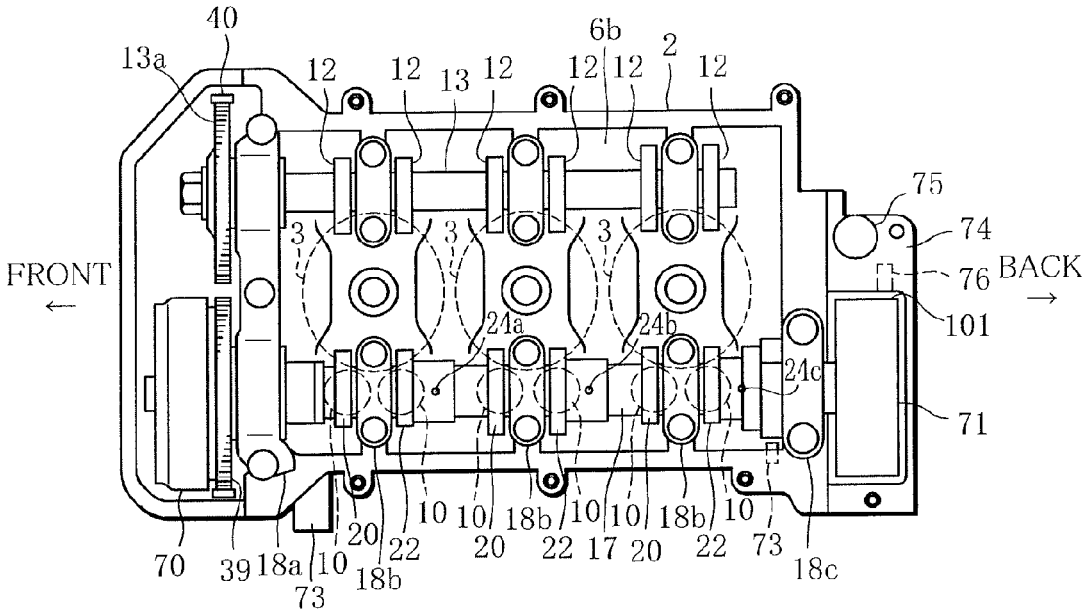
FIG. 12 is a plan view showing a structure in a cylinder head according to a sixth embodiment of the invention.
Figure 13:
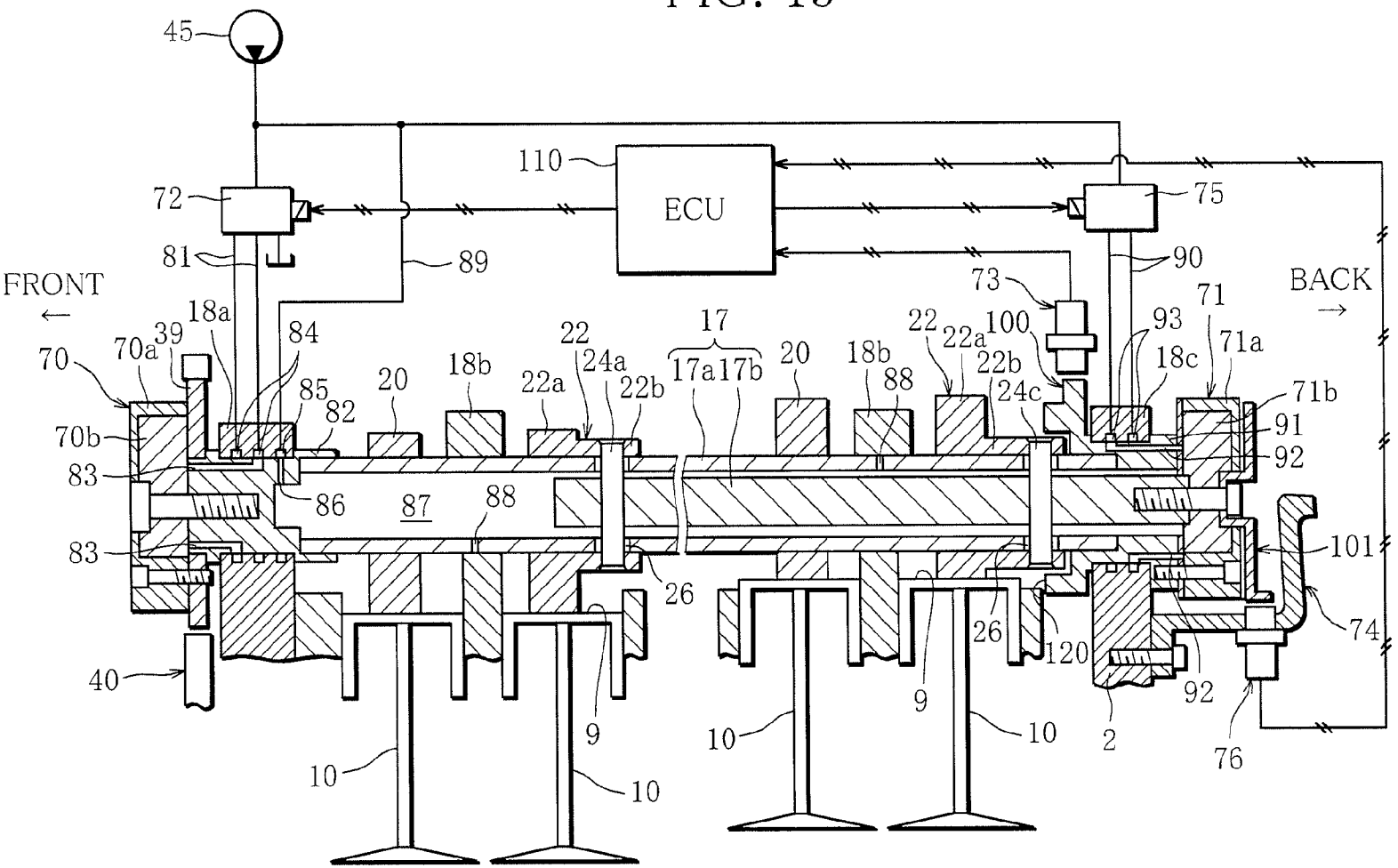
FIG. 13 is a plan view showing a structure of an exhaust camshaft according to the sixth embodiment of the invention.

As shown in FIGS. 12 and 13, according to the sixth embodiment, a first cam phase changing mechanism 70 and a second cam phase changing mechanism 71 are provided to both ends of the double shaft 17. The first cam phase changing mechanism 70 is disposed in a front end portion of the double shaft 17. More specifically, a timing sprocket 39 is fastened to a housing 70*a* of the first cam phase changing mechanism 70, and the outer camshaft 17*a* is fastened to a vane rotor 70*b* of the first cam phase changing mechanism 70.

The second cam phase changing mechanism 71 is disposed in a rear end portion of the double shaft 17. More specifically, the outer camshaft 17*a* is fastened to a housing 71*a* of the second cam phase changing mechanism 71, and the inner camshaft 17*b* is fastened to a vane rotor 71*b* of the second cam phase changing mechanism 71.

The first cam phase changing mechanism 70 has a function of varying a rotation angle of the outer camshaft 17*b* relative to the timing sprocket 39, whereas the second cam phase changing mechanism 71 has a function of varying a rotation angle of the inner camshaft 17*b* relative to the outer camshaft 17*a*. In other words, the first cam phase changing mechanism 70 has a function of varying the opening/closing timing of the entire intake valve 10 in relation to the opening/closing timing of the exhaust valve, and the second cam phase changing mechanism 71 has a split variable function that varies difference of the opening/closing timing of a pair of intake valves 10 as with the cam phase changing mechanism 25 in the first embodiment.

A first oil control valve 72 that controls the suction and discharge of operating oil supplied to the first cam phase changing mechanism 70 and a first cam sensor 73 (detection means) that detects actual rotation angle of the outer camshaft 17*b* are fastened to the cylinder head 2. Fastened to a rear portion of the cylinder head 2 is a cover 74 that accommodates a lower half part of the second cam phase changing mechanism 71. A second oil control valve 75 that controls the suction and discharge of operating oil supplied to the second cam phase changing mechanism 71 and a second cam sensor 76 that detects rotation angle of the vane rotor 71*b* of the second cam changing phase mechanism 71 are fastened to the cover 74.

The first oil control valve 72 and the second oil control valve 75 are supplied with operating oil from a hydraulic pressure supply portion 45 (for example, an oil pump that is fastened to the cylinder block of the engine 1).

The operating oil is supplied from the first oil control valve 72 to the first cam phase changing mechanism 70 through an oil passage 81 formed in the cylinder head 2 and an oil passage 83 formed in a cam piece 82. The cam piece 82 is a portion of a front end portion of the outer camshaft 17*a* supported by the bearing 18*a* and is formed to have a column-like shape. Oil grooves 84 are formed in an inner circumferential surface of the bearing 18*a* in a ring-like configuration. The oil passage 83 opens an outer circumferential surface of the cam piece 82 so as to face the oil grooves 84. This produces a structure in which the oil passages 81 and 83 are constantly connected together between the bearing 18*a* and the cam piece 82, which make relative rotation. The oil drained from the first oil control valve 72 is discharged into a cam chamber of the cylinder head 2 and a chain case. The oil supplied from the hydraulic pressure supply portion 45 is discharged into a space 87 between the outer camshaft 17*a* and the inner camshaft 17*b* through an oil passage 89 formed in the cylinder head 2, an oil passage 85 formed in the inner circumferential surface of the bearing 18*a*, and an oil passage 86 formed in the cam piece 82. The oil drained into the space 87 is supplied as lubricating oil to sliding portions of inner circumferential surfaces of the bearing 18*b* and the cam lobe 22 through an oil passage 88 and the long hole 26.

The operating oil is supplied from the second oil control valve 75 to the second cam phase changing mechanism 71 through an oil passage 90 formed in the cylinder head 2 and an oil passage 92 formed in a cam piece 91. The cam piece 91 is a portion of a rear end portion of the outer camshaft 17*b* supported by a bearing 18*c* and is formed to have a cylindrical shape. Oil grooves 93 are formed in an inner circumferential surface of the bearing 18*c* in a ring-like configuration. The oil passage 92 opens in an outer circumferential surface of the cam piece 91. This produces a structure in which the oil passages 90 and 92 are constantly connected to each other between the bearing 18*c* and the cam piece 91, which make relative rotation.

The first cam sensor 73 is situated adjacent to and in front of the bearing 18*c* located at the backmost position. A front end of the cam piece 91 is projecting from the bearing 18*c* in a forward direction. The front end portion extends in a radial outward direction and is provided with a sensor target 100 (material to be detected) of the first cam sensor 73. The first cam sensor 73 detects the actual rotation angle of the outer camshaft 17*a* by detecting the passing timing of the sensor target 100 along with the rotation of the outer camshaft 17*a*.

The second cam sensor 76 is situated so that a sensor target 101 fastened to the vane rotor 71*b* of the second cam phase changing mechanism 71 passes in front of a detection face. The second cam sensor 76 detects the passing timing of the sensor target 101 along with the rotation of the inner camshaft 17*b* and thus detects the actual rotation angle of the inner camshaft 17*b*. The sensor target 101 is a disc-like member that covers a rear face of the second cam phase changing mechanism 71 and is formed so that a part of an edge portion thereof is projecting to face the detection face of the second cam sensor 76.

An engine control unit 110 inputs not only driving conditions (torque, revolution, etc.) of the engine 1 but also a detection value of the first and second cam sensors 73 and 76, thereby controlling the first oil control valve 72 and the second oil control valve 75. On the basis of the driving conditions of the engine 1, the engine control unit 110 calculates a target value of the rotation angle of the outer camshaft 17*a*, which corresponds to the phase of the entire intake valves 10 and a target value of actual rotation angle difference between the outer camshaft 17*a* and the inner camshaft 17*b*, which corresponds to phase difference of the opening/closing timing of the intake valves 10. Moreover, the engine control unit 110 obtains the actual rotation angle difference between the outer camshaft 17*a* and the inner camshaft 17*b* on the basis of difference between the actual rotation angle of the outer camshaft 17*a*, which is inputted by the first cam sensor 73, and the actual rotation angle of the inner camshaft 17*b*, which is inputted by the second sensor 76. The engine control unit 110 controls the operation of the first cam phase changing mechanism 70 by controlling the first oil control valve 72 so that the actual rotation angle of the outer camshaft 17*a*, which is inputted by the first cam sensor 73, is equal to the target value. At the same time, the engine control unit 110 controls the operation of the second cam phase changing mechanism 71 by controlling the second oil control valve 75 so that the actual rotation angle difference between the outer camshaft 17*a* and the inner camshaft 17*b* is equal to the target value.

In other words, the phase of the entire intake valves 10 is varied by the first cam phase changing mechanism 70, and the actual phase is recognized from the rotation angle of the outer camshaft 17*a*, which is detected by the first cam sensor 73. The phase difference of the opening/closing timing of the intake valves 10 is varied by the second cam phase changing mechanism 71, and the actual phase difference is recognized from the rotation angle difference between the outer camshaft 17*a* and the inner camshaft 17*b*, which is detected by the first cam sensor 73 and the second cam sensor 76.

Particularly in the present embodiment, the boss portion 22*b* of the cam lobe 22 extends rearwards, and pin members 24 (24*a* to 24*c*) are positioned absolutely behind tappets 9 of intake valves 10 driven by respective cam lobes 22.

Among the cam lobes 22, the backmost cam lobe 22 has a rear end projecting rearwards up to the vicinity of the cam piece 91. A projecting portion 120 is projecting forwards so as to cover at least a part of each end face of the pin member 24*c*. To be more specific, the projecting portion 120 is projecting forward in a ring-like shape and has an internal diameter that is slightly larger than an external diameter of a boss portion 22*a*. A depression formed by the projecting portion 120 is covered with a rear end portion of the boss portion 22*a* including at least a part of the pin member 24.

As described above, since the projecting portion 120 is provided to the cam piece 91 so as to face both the ends of the pin member 24, for example, even if the pin member 24*c* intends to shift outwards, the end face of the pin member 24*c* interferes with the projecting portion 120. The outward shifting of the pin member 24*c* is thus restricted. For example, if the pin member 24*c* escapes due to alternate load at the time of the valve lift, the projecting portion 120 inhibits the escape of the pin member 24*c*. The pin member 24 is thus prevented from interfering with and damaging the cylinder head 2 and the tappet 9 by escaping and projecting. In particular, the pin member 24 that has escaped and projected is prevented from damaging components of the tappet 9 of the intake valve 10 and the like and thus making the intake valve 10 incapable of shifting in an open state. Peripheral components, such as a con rod, a crank, and the cylinder block, are reliably prevented from being damaged. Even if the pin member 24*c* is fractured by a cam driving force, the fractured part of the pin member 24 does not fall off due to the projecting portion 120, and is thus prevented from falling off and biting into the intake valve 10 and the tappet 9 to make the intake valve 10 and the tappet 9 incapable of shifting in the open state.

Since the sixth embodiment provides the projecting portion 120 to the cam piece 91, the escape of the pin member 24 can be achieved with a simple structure by using the cam piece 91 that is a separate functional component disposed adjacent to the pin member 24*c*.

According to the sixth embodiment, the escape prevention is provided to the pin member 24*c* connecting the backmost cam lobe 22 among the three cam lobes 22. This is because the sixth embodiment has a structure in which the second cam phase changing mechanism 71 is rotated at the rear end of the inner cam shaft 17*b*, and the number of times the inner camshaft 17*b* receives torsion is higher in the rear portion since the torsion is accumulated in the rear portion due to the alternate load at the time of valve lift. Another reason is that, even if torsion resonance is generated in the inner camshaft 17*b*, torsion stress is applied to a side that is close to the second cam changing mechanism 71, so that there occurs a large deformation, and it is highly likely that the backmost pin member 24*c* among the pin members 24*a* to 24*c* escapes or fractures. It is then possible to effectively apply the invention only to the pin member 24*c* that is highly likely to escape among the pin members 24*a* to 24*c*, and successfully obtain the advantage of escape prevention with a simpler structure.

Since the sensor target 100, in addition to the projecting portion 120, is integrally formed in the front end portion of the cam piece 71, when the pin member 24 escapes and collides with the projecting portion 120, the projecting portion 120 of the cam piece 91 is deformed together with the sensor target 100, and there causes output abnormality in the first cam sensor 73. It is therefore possible to detect the escape of the pin member 24 from the output abnormality of the first cam sensor 73.

In the sixth embodiment, there is created a small space between the end face of the pin member 24*c* and an internal surface of the projecting portion 120. This way, the advantage of escape prevention of the pin member 24*c* can be retained, and at the same time, error in an internal diameter of the projecting portion 120 is allowed, which improves productivity. In the event if the pin member 24*c* is fractured, a fractured piece is prevented from falling off.

In addition, since the pin members 24*a* to 24*c* are positioned absolutely behind the tappet 9 of the intake valve 10, even if the pin members 24*a* to 24*c* fall off, they are prevented from colliding directly with the tappet 9. The pin members 24*a* and 24*b* are also prevented from at least damaging the intake valve 10.

Figure 14:
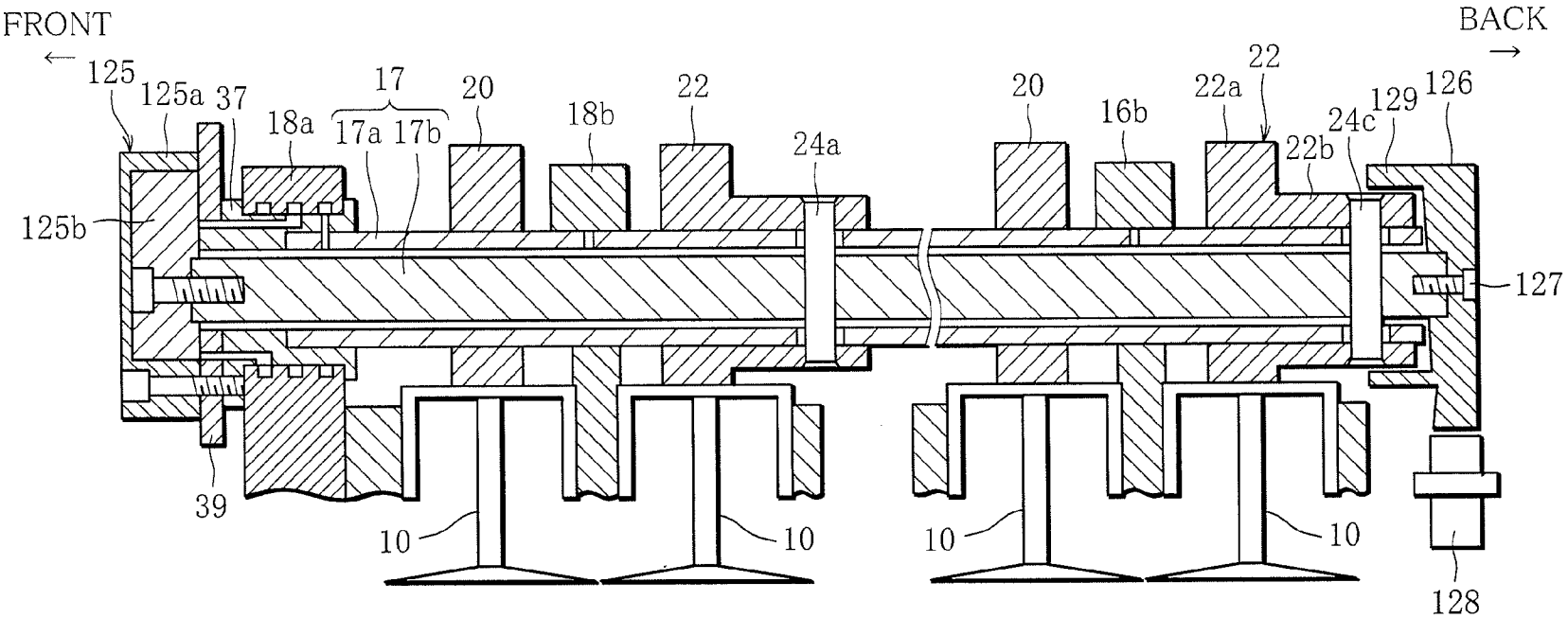
FIG. 14 is a sectional view showing a structure of an exhaust camshaft according to a seventh embodiment of the invention.
Figure 15:
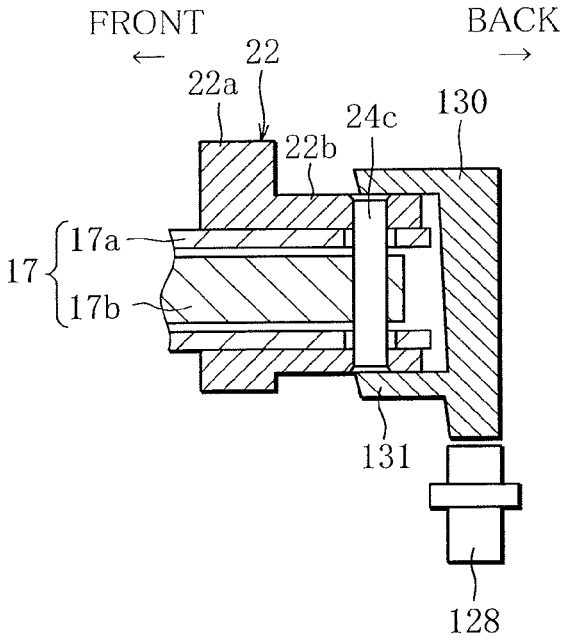
FIG. 15 is a fragmentary sectional view showing a structure of an exhaust camshaft according to an eighth embodiment of the invention.
Figure 16:
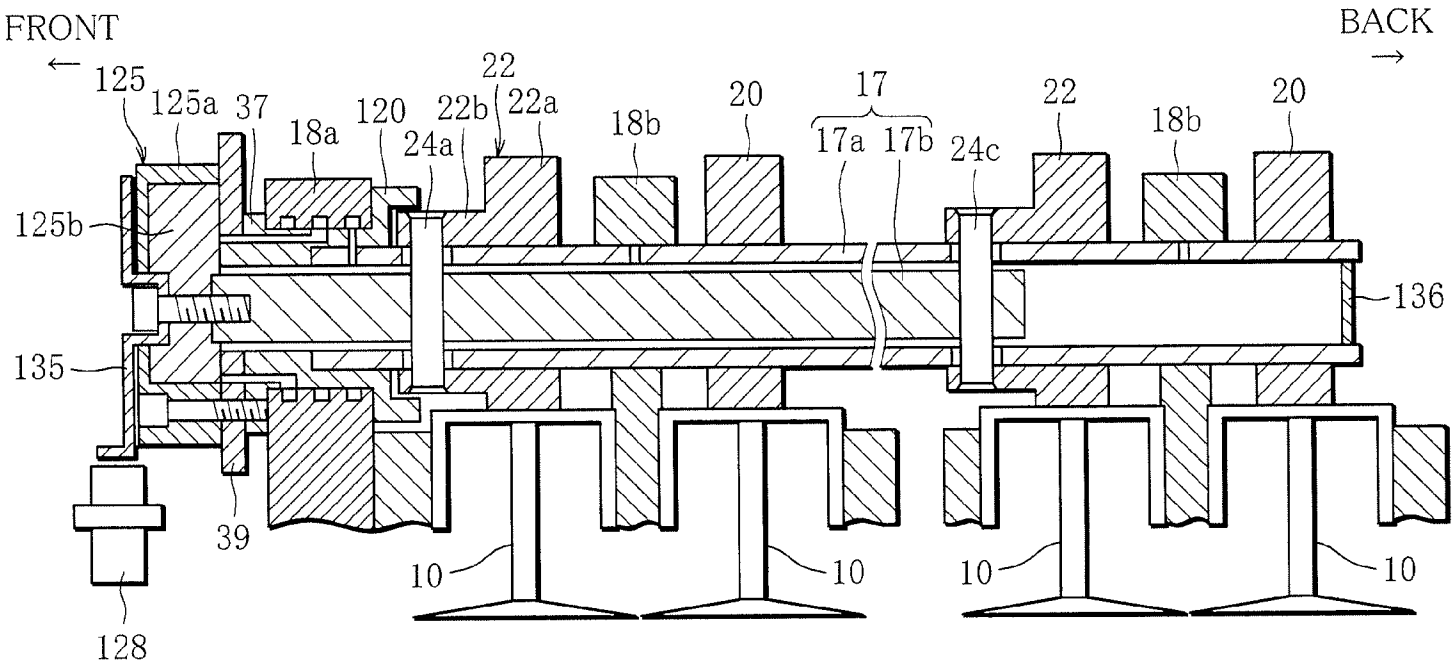
FIG. 16 is a sectional view showing a structure of an exhaust camshaft according to a ninth embodiment of the invention.

FIG. 14 is a sectional view showing a structure of an intake camshaft 14 according to a seventh embodiment of the invention. FIG. 15 is a sectional view showing a structure of a rear end portion of the intake camshaft 14 according to an eighth embodiment of the invention. FIG. 16 is a sectional view showing a structure of a valve mechanism of the intake camshaft 14 according to a ninth embodiment of the invention.

As shown in FIG. 14, the seventh embodiment differs from the sixth in that the cam phase changing mechanism is not provided to the rear end of the double shaft 17, and that a cam phase changing mechanism 125 provided to the front end of the double shaft 17 is an actuator having a split variable function.

To be specific, the timing sprocket 39 is fastened to a housing 125*a* of the cam phase changing mechanism 125, and the outer camshaft 17*a* is fastened to a vane rotor 125*b* of the first cam phase changing mechanism 125. As in the first embodiment, the opening/closing timing of one of the intake valves 10 is fixed, whereas that of the other intake valve 10 is varied by the cam phase variable mechanism 125.

The rear end of the inner camshaft 17*b* is projecting in a rearward direction slightly further than the rear end of the outer camshaft 17*a*. A sensor target 126 (material to be detected) of the inner camshaft 17*b* is fastened to the rear end of the inner camshaft 17*b* with a bolt 127. The sensor target 126 is a disc-like member. A detection face of a cam sensor 128 (detection means) that detects the actual rotation angle of the inner camshaft 17*b* is disposed in an outer circumferential surface of the sensor target 126. The actual rotation angle of the inner camshaft 17*b*, which is detected by the cam sensor 128, is used to control the operation of the cam phase variable mechanism 125. In an outer circumferential portion of the sensor target 126, there is provided projections 129 projecting like a flange in a forward direction. The projections 129 cover at least a part of end faces of the pin member 24*c* connecting the backmost cam lobe 22, and are arranged to restrict the outward shifting of the pin member 24*c*.

According to the seventh embodiment, therefore, the sensor target 126 disposed to the rear end of the double shaft 17 is also used to prevent the escape of the pin member 24*c*. In the above-described manner, the present embodiment uses the sensor target 126 that is another functional component disposed adjacent to the pin member 24*c* to achieve the escape prevention of the pin member 24*c* with a simple structure.

According to the seventh embodiment, the escape prevention is provided to the pin member 24*c* connecting the backmost cam lobe 22 as in the sixth embodiment. However, the rear end of the inner camshaft 17*b* is formed into a free end, so that a front end portion is rotated by the cam phase changing mechanism 125. In this case, the outer camshaft 17*a* and the inner camshaft 17*b* have substantially the same length. The rear end of the inner camshaft 17*b* that is positioned farthest from the cam phase changing mechanism 125 oscillates most. Depending upon the scale of this oscillation, the possibility of escape of the pin member 24*c* is increased. Among the pin members 24*a* to 24*c*, therefore, the escape prevention is effectively carried out with respect to the pin member 24*c* only, which is most likely to escape.

As shown in FIG. 15, an eighth embodiment of the invention differs from the seventh in the shape of a sensor target 130 (material to be detected).

The sensor target 130 of the eighth embodiment is fastened not to the inner camshaft 17*b* but to the cam lobe 22. The sensor target 130 is formed to have a shape of a lid covering the rear end of the double shaft 17. In an outer circumferential portion thereof, projections 131 are formed like a flange. If the rear end portion of the cam lobe 22 is tightly fitted into the projections 131, the sensor target 130 is fastened. In this case, if the projections 131 are designed to cover at least a part of the ends of the pin member 24*c*, the sensor target 130 functions as an escape stopper for the pin member 24*c*. In particular, the eighth embodiment offers easy assembly because a sensor target 90 can be fastened without bolt.

As shown in FIG. 16, according to a ninth embodiment, the cam phase changing mechanism 125 is disposed in the front end of the double shaft 17, and the rear end of the inner camshaft 17*a* is a free end as in the seventh embodiment. In the present embodiment, however, the cam sensor 128 is disposed in front of the double shaft 17. A sensor target 135 is accordingly fastened in front of the cam phase changing mechanism 125 with a bolt for fastening the vane rotor 125*b* and the inner camshaft 17*b*.

The rear end of the outer camshaft 17*a* is closed with a disc-like plug 136. This prevents an outflow of the lubricating oil supplied between the inner camshaft 17*a* and the outer camshaft 17*b*.

According to the present embodiment, in each cylinder, the cam lobe 22 driven by the inner camshaft 17*a* is located in front, and the reference cam 20 fastened to the outer camshaft 17*b* is located at the rear. The pin member to be provided with escape prevention is the pin member 24*a* connecting the front cam lobe 22. In the front cam lobe 22, the front end of the boss portion 22*b* extends forwards as far as a point close to the cam piece 37 of the front end portion of the outer camshaft 17*a*. In the rear end portion of the cam piece 37, there is provided a projection 120 projecting rearwards to cover the front end portion of the boss portion 22*b* of the cam lobe 22. As in the sixth embodiment, the projection 120 is designed to cover at least a part of the end faces of the pin member 24*a*. The present embodiment is thus capable of preventing the escape of the pin member 24*a* by using the cam piece 37. According to the present embodiment, the inner camshaft 17*b* is shorter than the outer camshaft 17*a*, and the cam phase changing mechanism 125 is used to rotate the front end of the inner camshaft 17*b*. The number of times the inner camshaft 17*b* receives torsion due to alternate load at the time of valve lift is higher in the front portion since the torsion is accumulated in the front portion of the inner camshaft 17*b* located closer to the cam phase changing mechanism 125. This raises the possibility of escape of the pin member 24*a*. The pin member 24*a* is provided with escape prevention, which is located closest of the pin members 24*a* to 24*c* to the front end of the inner camshaft 17*b*.

The invention is not limited to the above-described embodiments and may be modified in various ways without deviating from the gist of the invention. For example, the first and second embodiments use the pin member that can be subjected to the swaging process and the large diameter portion that is formed by the swaging process. It is also possible, instead, to utilize a rivet member as the pin member and apply the swaging process to the rivet, to thereby form an escape-preventing portion. The point is that a pin-like member that is movably inserted and an escape-preventing portion are combined together.

Although the sixth to ninth embodiments provide the projections 120, 129 and 131 for the escape prevention of the pin member 24 to the cam pieces 37 and 91 or the sensor targets 126 and 130, the invention is not limited to this. For example, the projection 120 or the like may be provided to another functional component that is disposed adjacent to the pin member to be provided with escape prevention, such as an assembly hexagon nut fixed to the outer periphery of the outer camshaft 17*b*.

In the sixth to ninth embodiments, the escape prevention is provided to the pin member 24*a* connecting the frontmost cam lobe 22 among all the cam lobes 22 or the pin member 24*c* connecting the backmost cam lobe 22. The escape prevention, however, may be provided to both the front and backmost pin members 24*a* and 24*c*. The pin member 24*b* connecting the cam lobe 22 other than both the outermost cam lobes may be provided with the projection 120 or the like covering both the ends of the pin member 24 for escape prevention if another functional component such as the hexagon nut is adjacently located.

In the above-described embodiments, the invention is applied to the intake-side variable valve device. Instead, the invention may be applied to an exhaust-side variable valve device as long as the engine is equipped with a variable valve device on the exhaust side. Moreover, the invention may be applied not only in a three-cylinder engine but also in an engine with any number of cylinders.

REFERENCE MARKS

14 Intake camshaft
15 Variable valve device
17 Double shaft (shaft member)
17*a* Outer camshaft
17*b* Inner camshaft
20 Reference cam
21 Connecting structure (connecting means)
22 Cam lobe (movable cam)
22*b* Boss portion
24 Pin member (pin-like member)
50 Escape-preventing portion (escape-preventing member)
52, 53 Through hole
54 Large diameter portion
60 Releasing portion
61 Triangular portion
62 Tapered face
65 Stopper (escape-preventing portion)
68 Spherical face
82, 91 Cam piece
100, 126, 130 Sensor target (material to be detected)
120, 129, 131 Projection (escape-preventing portion)

The invention claimed is:

1. A variable valve device for an internal combustion engine comprising:

a shaft member that is configured by turnably encasing an inner camshaft in an outer camshaft formed of a pipe member and can be driven by crank output of an internal combustion engine;

a reference cam disposed in an outer periphery of the outer camshaft;

a movable cam disposed to be turnable around an axis of the outer camshaft;

connecting means that connects the movable cam and the inner camshaft together while allowing relative displacement of the outer camshaft and the inner camshaft, in which the relative displacement of the outer camshaft and the inner camshaft makes the movable cam variable in phase on the basis of the reference cam, wherein the connecting means includes:

a pin-like member that is movably inserted so as to penetrate the movable cam, the outer camshaft and the inner camshaft along a diametrical direction of the shaft member, and transmits relative displacement between the inner and outer camshafts to the movable cam; and an escape-preventing portion that restricts the pin-like member from escaping, and the pin-like member is radially displaceable from a first position to a second position with respect to the inner and outer camshafts while escape thereof is restricted by the escape-preventing portion.

2. The variable valve device for an internal combustion engine according to claim 1, wherein the pin-like member is designed to have length longer than a penetration zone that penetrates through the outer camshaft and the inner camshaft;

the escape-preventing portion is disposed to be displaceable in a diametrical direction of the shaft member while being disposed in the end portion of the pin-like member;

a releasing portion is formed in the escape-preventing portion and an end of the penetration zone, which releases the escape-preventing portion from the end of the penetration zone when load is applied to a portion between the escape-preventing portion and the end of the penetration zone; and the farther the escape-preventing portion moves away from the end of the penetration zone, the more the pin-like member is displaced in an axial direction.

3. The variable valve device for an internal combustion engine according to claim 1, wherein the movable cam has a cylindrical boss portion turnably fitted to the outer periphery of the outer camshaft;

the pin-like member that is movably inserted so as to penetrate the boss portion, the outer camshaft and the inner camshaft along a diametrical direction of the shaft member, and has a length slightly shorter than an external diameter of the boss portion; and the escape-preventing portion is disposed in the boss portion and prevents and restricts the pin-like member from escaping outside the movable cam along the axial direction.

4. The variable valve device for an internal combustion engine according to claim 3, wherein the escape-preventing portion is formed of a stopper that is fitted to an outer periphery of the boss portion.

5. The variable valve device for an internal combustion engine according to claim 4, wherein the stopper is formed into a ring.

6. The variable valve device for an internal combustion engine according to claim 4, wherein the end portion of the pin-like member is formed into a spherical face.

* * * * *